US007315316B2

(12) United States Patent
Kitamura et al.

(10) Patent No.: US 7,315,316 B2
(45) **Date of Patent: *Jan. 1, 2008**

(54) PRINTER

(75) Inventors: Norikazu Kitamura, Wakayama (JP); Motoharu Habata, Wakayama (JP); Takayuki Hasegawa, Wakayama (JP)

(73) Assignee: Noritsu Koki Co., Ltd., Wakayama-shi (JP)

( * ) Notice: Subject to any disclaimer, the term of this patent is extended or adjusted under 35 U.S.C. 154(b) by 177 days.

This patent is subject to a terminal disclaimer.

(21) Appl. No.: 11/084,202

(22) Filed: Mar. 21, 2005

(65) Prior Publication Data

US 2005/0212889 A1 Sep. 29, 2005

(30) Foreign Application Priority Data

Mar. 25, 2004 (JP) ..... 2004-089511

(51) Int. Cl.
*B41J 2/315* (2006.01)
*B41J 2/325* (2006.01)

(52) U.S. Cl. ..... 347/171; 347/219

(58) Field of Classification Search ..... 347/171, 347/174, 176, 183, 218, 219
See application file for complete search history.

(56) References Cited

U.S. PATENT DOCUMENTS 5,777,654 A * 7/1998 Park ..... 347/176
2001/0019352 A1 9/2001 Miyazaki
2003/0146971 A1 8/2003 Mogi
2004/0061768 A1* 4/2004 Nishimura ..... 347/218

FOREIGN PATENT DOCUMENTS

JP 8-174876 A 7/1996
JP 9-99572 A 4/1997
JP 9-267500 A 10/1997
JP 2001-246769 A 9/2001

* cited by examiner

*Primary Examiner*—K. Feggins
(74) *Attorney, Agent, or Firm*—Smith Patent Office

(57) ABSTRACT

A printer includes a conveyance mechanism capable of conveying a long recording medium in a first direction from a supply unit storing therein the recording medium, toward an image recording unit capable of recording a color image on the recording medium, and in a second direction reverse to the first direction, with opposing the recording medium to the image recording unit. The conveyance mechanism is controlled to convey the recording medium in the first direction until a leading edge of the recording medium reaches a position distant in the first direction from the image recording unit, and then convey the recording medium in the second direction. The image recording unit is controlled to record frames of color images on the recording medium being conveyed in the second direction by the conveyance mechanism, and form a non-record region in which no image is recorded, on the recording medium between the leading edge and the last recorded color image.

4 Claims, 6 Drawing Sheets

PRINTER

BACKGROUND OF THE INVENTION

1. Field of the Invention

The present invention relates to a printer for recording color images on a recording medium.

2. Description of Related Art

Various techniques are known in relation to printers each of which can record a color image on a recording medium. For example, JP-A-8-174876 discloses a one-path type color thermal printer having three thermal heads that can record colors of yellow, magenta, and cyan, respectively. The three thermal heads cooperate with each other to record a color image on a recording paper unwound from a recording paper roll and being conveyed in a paper feed direction.

JP-A-9-99572 discloses a three-path type color thermal printer. In this printer, a portion of a heat-sensitive color recording paper of a length corresponding to one frame, unwound from a recording paper roll, is conveyed forward so as to be opposite to one thermal head, and then conveyed backward. In the backward conveyance, a yellow image is recorded on the portion of the recording paper. Afterward, such forward and backward conveyances of the recording paper are repeated alternately. A magenta image is recorded in the second backward conveyance. A cyan image is recorded in the third backward conveyance.

JP-A-2001-246769 discloses a one-path type color thermal printer having three thermal heads for yellow, magenta, and cyan. A recording paper unwound from a recording paper roll is conveyed in a paper feed direction. After completion of preparation for printing, the recording paper is conveyed backward. In the backward conveyance, one frame of color image is recorded on the recording paper. In this printer, after the one frame of color image is recorded, the recording paper is again conveyed in the paper feed direction and then the portion of the recording paper on which the one frame of color image has been recorded is cut off at the rear end of the color image. After the portion of the recording paper on which the one frame of color image has been recorded is discharged, the remaining portion of the recording paper, which has completed preparation for printing is again conveyed backward to record thereon the next one frame of color image.

In the printer disclosed in JP-A-8-174876, a color image can be recorded, even without conveying the recording paper in both the forward and backward directions, with conveying the recording paper in only one direction. In this printer, however, if the three thermal heads are pressurized onto the recording paper in the order of the thermal heads the printing position of which the recording paper has reached, the image to be recorded may be deteriorated due to variation of load in the conveyance of the recording paper. For this reason, such a printer is designed so as to start recording a color image after all the three thermal heads are pressurized onto the recording paper. As a result, any image can not be recorded in a region near the leading edge of the recording paper between the most upstream thermal head and the most downstream thermal head in the conveyance direction.

Contrastingly, the printer disclosed in JP-A-9-99572 or JP-A-2001-246769 can record a color image even in a region near the leading edge of the recording paper. Thus, the recording paper is hardly wastefully consumed. In addition, in the printer disclosed in JP-A-2001-246769, because all the three thermal heads are being pressurized onto the recording paper while the recording paper is conveyed backward, the image to be recorded is hardly deteriorated due to variation of load in the conveyance of the recording paper.

In the printer disclosed in JP-A-9-99572, however, the conveyance of the recording paper in either of the forward and backward directions must be repeated three times for recording one frame of color image. Similarly in the printer disclosed in JP-A-2001-246769, the conveyance of the recording paper in either of the forward and backward directions must be carried out every time when one frame of color image is recorded. Therefore, when a plurality of frames of color images are recorded with such a printer, the conveyance of the recording paper in either of the forward and backward directions must be repeated many times. More specifically, in the case of recording m frames of color images (m: an integer of two or more), the recording paper must be conveyed in either of the forward and backward directions 3m times in the printer disclosed in JP-A-9-99572, and m times in the printer disclosed in JP-A-2001-246769.

In the printer disclosed in JP-A-9-99572 or JP-A-2001-246769, a pair of conveyance rollers are disposed between the recording paper roll and the thermal heads. The conveyance direction of the recording paper is changed to one of the paper feed direction and the backward direction by switching over the driving direction of the pair of conveyance rollers. Therefore, in the case of the printer disclosed in JP-A-9-99572, the driving direction of the pair of conveyance rollers must be switched over (6m−1) times. In the case of the printer disclosed in JP-A-2001-246769, the driving direction of the pair of conveyance rollers must be switched over (2m−1) times.

Such an operation of switching over the driving direction of the pair of conveyance rollers brings about a time loss. Therefore, if the number of times of switching over the driving direction of the pair of conveyance rollers increases, the total time loss increases accordingly. As a result, the processing performance of the printer lowers. Thus, the techniques disclosed in JP-A-9-99572 and JP-A-2001-246769 can not realize a high processing performance.

As image recording methods each using a thermal head, there are a thermal transfer method and a thermal recording method. In the thermal transfer method, which is further classified into a phase change type and a dye sublimation type, an ink ribbon is interposed between a thermal head and a recording paper and ink applied on the ink ribbon is selectively transferred onto the recording paper by the thermal head to record an image on the recording paper. Contrastingly, in the thermal recording method, a recording paper having heat sensitivity is used. Thus, an image can be recorded on the recording paper by using no ink ribbon. In either method, during a printing operation, the thermal head must be brought into close contact with the ink ribbon in the thermal transfer method or the recording paper in the thermal recording method without interposing any air layer, or must be very close to the ink ribbon or the recording paper. Such a thermal head includes a large number of heating elements that are arranged in a row and can be selectively electrified. It is known that such a thermal head may break down due to overheating if heating elements are electrified while the thermal head is not opposite to a recording paper or if the heating elements are not being opposed to the recording paper immediately after the electrification is stopped.

SUMMARY OF THE INVENTION

An object of the present invention is to provide a printer capable of recording a plurality of frames of color images with a high processing performance with intending to reduce wasteful consumption of a recording medium and prevent the images from being deteriorated due to variation of load in conveyance of the recording medium, and capable of suppressing breakdown of an image recording unit such as a thermal head.

A printer according to the present invention comprises a supply unit storing therein a long recording medium; an image recording unit including a large number of heating elements and capable of recording a color image by the heating elements selectively heated; a conveyance mechanism capable of conveying the recording medium in a first direction from the supply unit toward the image recording unit and in a second direction reverse to the first direction, with opposing the recording medium to the image recording unit; a conveyance controller that controls the conveyance mechanism to convey the recording medium in the first direction until a leading edge of the recording medium reaches a position distant in the first direction from the image recording unit, and then convey the recording medium in the second direction; and an image recording controller that controls the image recording unit to record a plurality of frames of color images on the recording medium being conveyed in the second direction by the conveyance mechanism, and form a non-record region in which no image is recorded, on the recording medium between the leading edge and the last recorded color image.

In the present invention, "a leading edge of the recording medium reaches a position distant in the first direction from the image recording unit" means that "the recording medium is conveyed in the first direction from the supply unit toward the image recording unit and the leading edge of the recording medium reaches a position downstream of the image recording unit".

According to the present invention, because a plurality of frames of color images are recorded on the recording medium being conveyed in the second direction after the recording medium is conveyed in the first direction, variation of load scarcely occurs while the images are recorded on the recording medium, and color images can be recorded even in the vicinity of the leading edge of the recording medium. That is, deterioration of the images due to the variation of load during the conveyance of the recording medium can be prevented with reducing wasteful consumption of the recording medium. In addition, a plurality of frames of color images can be recorded on the recording medium by one recording operation corresponding to one set of forward and backward movements of the recording medium. Thus, the time loss attendant upon switchover of the conveyance direction can be reduced and a plurality of frames of color images can be recorded with a high processing performance.

In addition, the heating elements continue to face the recording medium being conveyed in the second direction, for a period of time after the last color image is recorded. Thus, heat of the heating elements rapidly diffuse through the recording medium, and the temperature of the heating elements, which was high immediately after the images were recorded, goes down rapidly. Thus, the image recording unit is hard to break down.

In the printer according to the present invention, it is preferable that the printer further comprises a length calculator that calculates a length exceeding a minimum length of the recording medium necessary for recording the plurality of frames of color images by the image recording unit, determined on the basis of the number of frames of color images to be recorded by the image recording unit, a desired size of each color image, and desired margins between the color images; the conveyance controller controls the conveyance mechanism to convey the recording medium in the first direction until the leading edge of the recording medium reaches the position distant in the first direction from the image recording unit by not less than the length calculated by the length calculator, and then convey the recording medium in the second direction; and the image recording controller controls the image recording unit to record the plurality of frames of color images on the recording medium being conveyed in the second direction by the conveyance mechanism, into the respective desired sizes at intervals corresponding to the desired margins, and form the non-record region in which no image is recorded, on the recording medium between the leading edge and the last recorded color image.

In the printer according to the present invention, it is also preferable that the printer further comprises a length calculator that calculates a minimum length of the recording medium necessary for recording the plurality of frames of color images by the image recording unit, on the basis of the number of frames of color images to be recorded by the image recording unit, a desired size of each color image, and desired margins between the color images; the conveyance controller controls the conveyance mechanism to convey the recording medium in the first direction until the leading edge of the recording medium reaches the position distant in the first direction from the image recording unit by more than the length calculated by the length calculator, and then convey the recording medium in the second direction; and the image recording controller controls the image recording unit to record the plurality of frames of color images on the recording medium being conveyed in the second direction by the conveyance mechanism, into the respective desired sizes at intervals corresponding to the desired margins, and form the non-record region in which no image is recorded, on the recording medium between the leading edge and the last recorded color image.

According to those features of the present invention, with suppressing breakdown of the image recording unit, the plurality of frames of color images can be recorded into the respective desired sizes at intervals of the desired margins.

In the printer according to the present invention, it is preferable that a length of the non-record region is not less than a length obtained by multiplying a time period necessary for temperatures of the heating elements immediately after it ends to record the plurality of frames of color images on the recording medium, to become substantially equal to a temperature of surroundings, by a conveyance speed of the recording medium in the second direction.

According to the present invention, the heating elements continue to face the recording medium until the temperature of the heating elements becomes substantially equal to the temperature of the surroundings after the last color image is recorded. Thus, the image recording unit is harder to break down in comparison with a case wherein the heating elements fall in a state of not being opposed to the recording medium when the temperatures of the heating elements are higher than the temperature of the surroundings.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
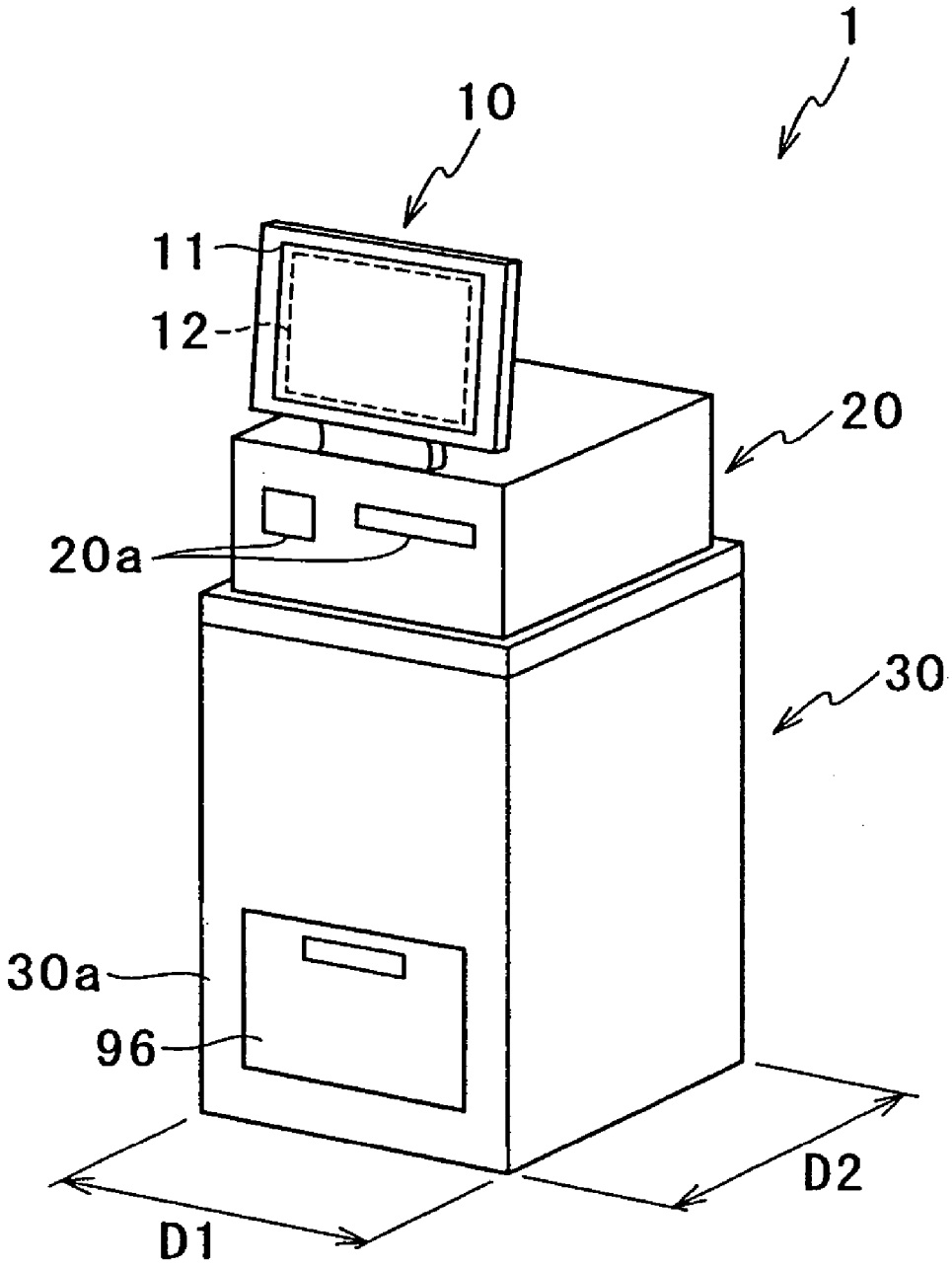
FIG. 1 is an external perspective view of a printer according to an embodiment of the present invention.
Figure 2:
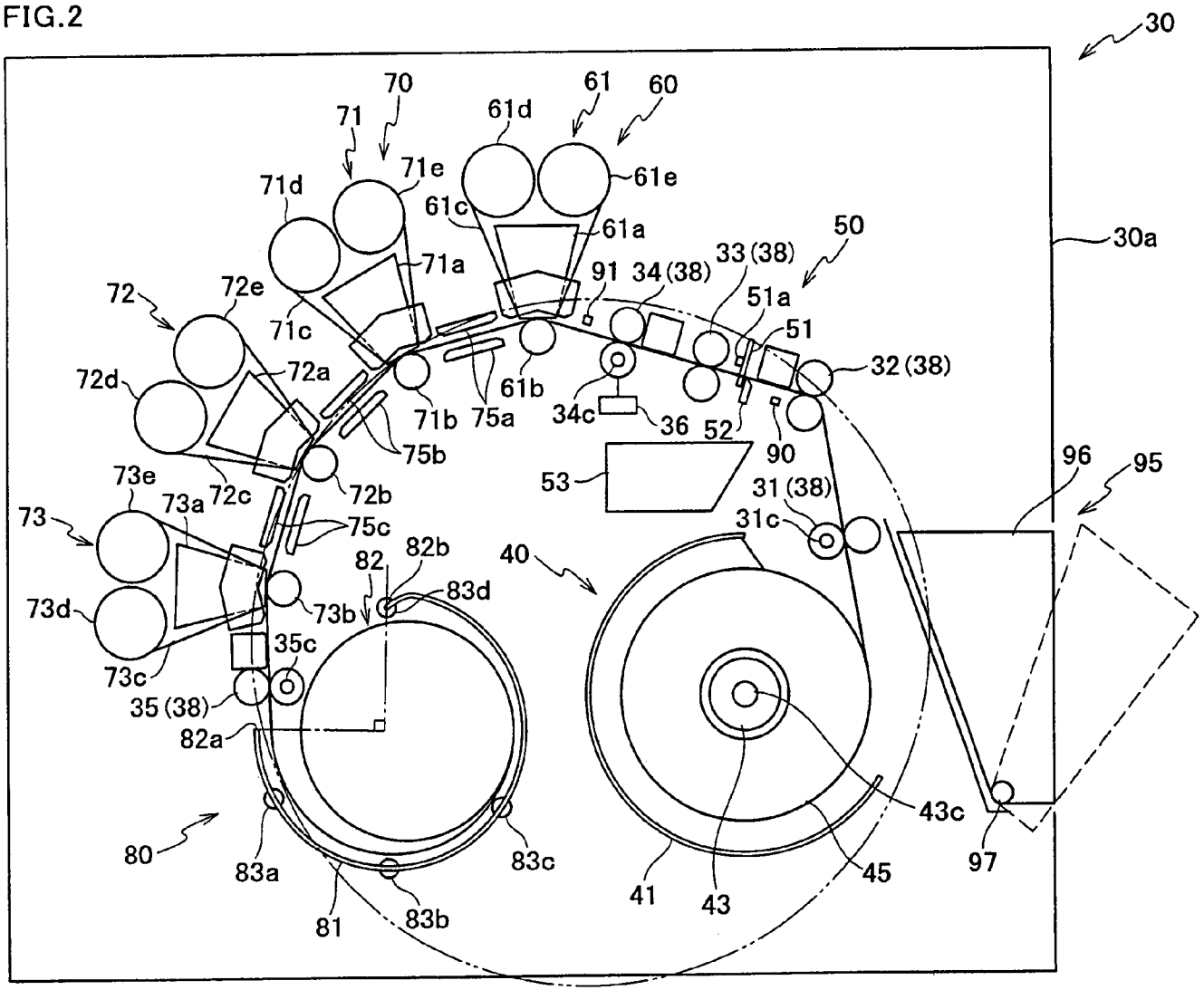
FIG. 2 is a view showing a general construction of a print unit of the printer of FIG. 1.
Figure 3A:
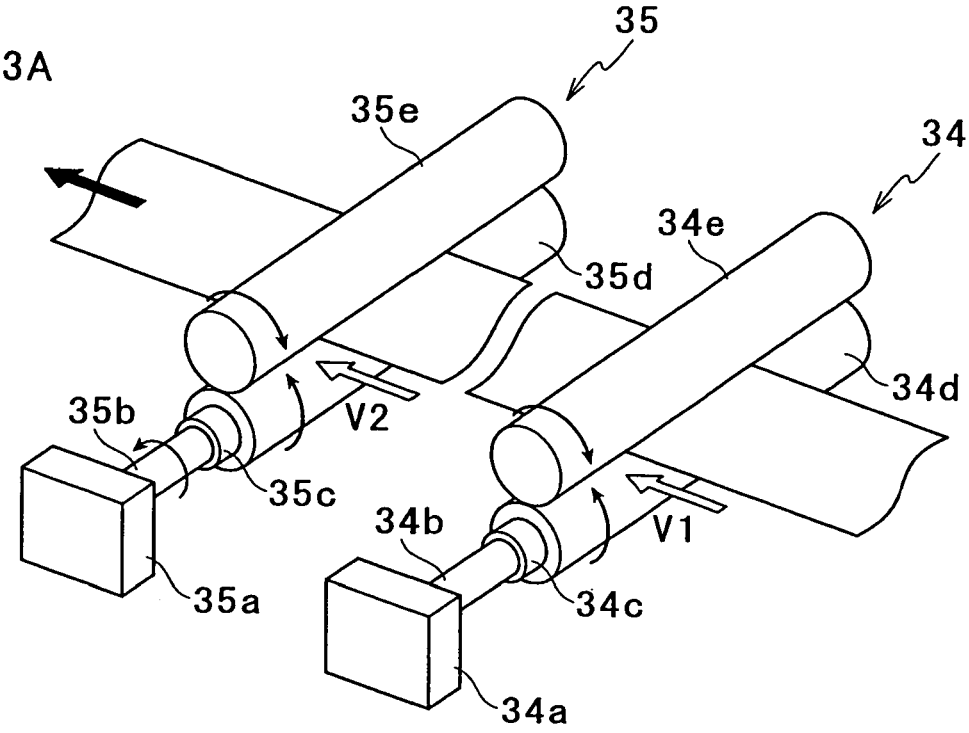
FIGS. 3A and 3B are views showing operations of a pair of conveyance rollers and a pair of sending-in rollers of the printer of FIG. 1.
Figure 3B:
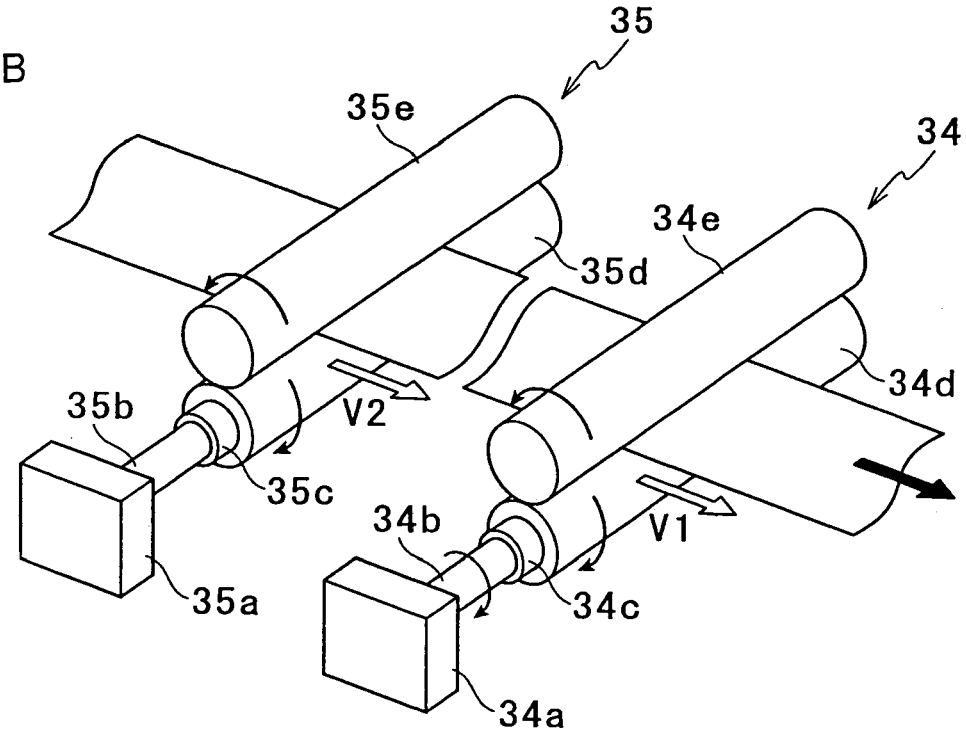
Figure 4:
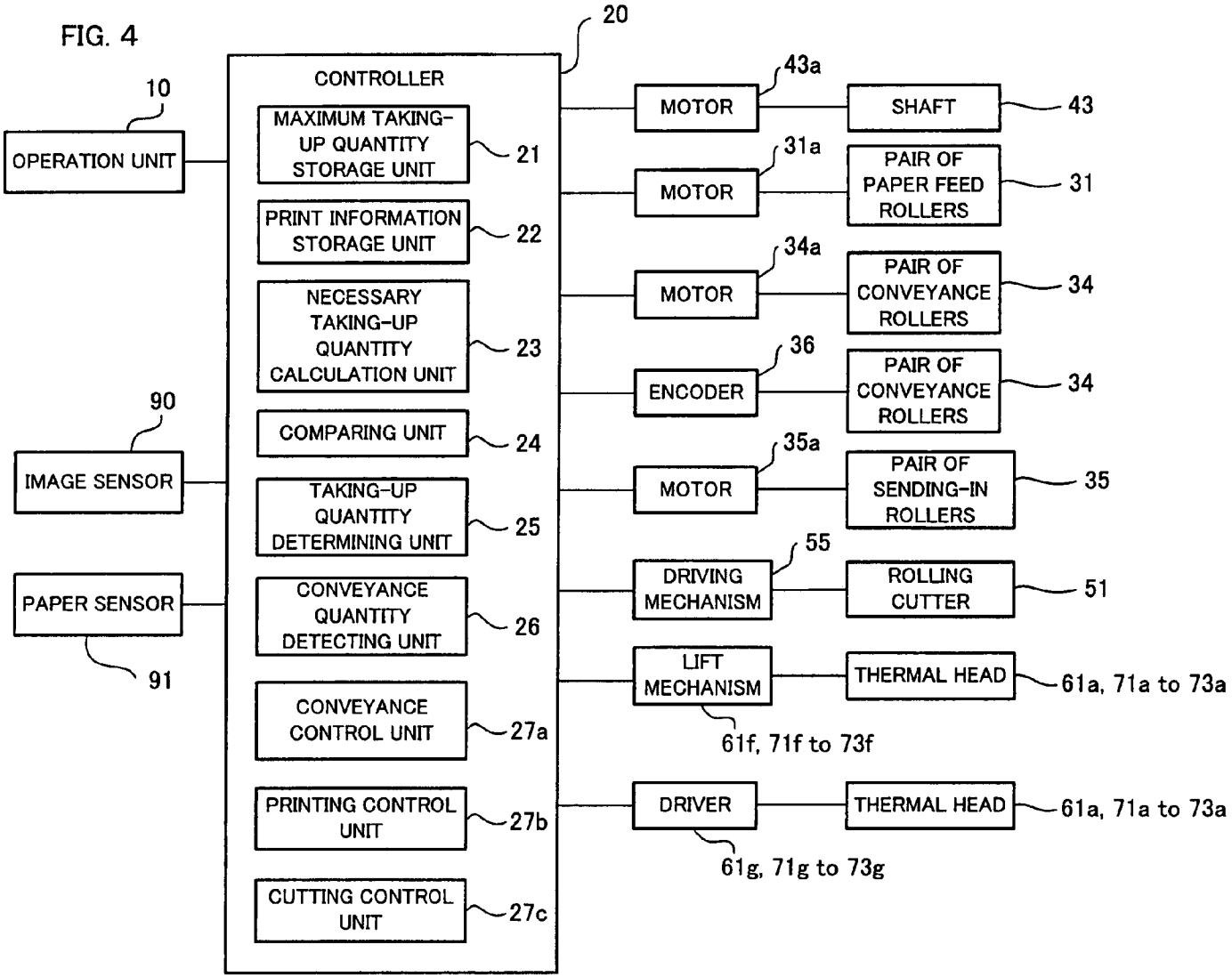
FIG. 4 is a block diagram showing principal components of the printer of FIG. 1 and a controller to which the components are connected.

Hereinafter, a preferred embodiment of the present invention will be described with reference to drawings. FIG. 1 is an external perspective view of a printer according to an embodiment of the present invention. FIG. 2 is a view showing a general construction of a print unit of the printer of FIG. 1. FIGS. 3A and 3B are views showing operations of a pair of conveyance rollers and a pair of sending-in rollers of the printer of FIG. 1. FIG. 4 is a block diagram showing principal components of the printer of FIG. 1 and a controller to which the components are connected.

A dye sublimation printer 1 as shown in FIG. 1 (hereinafter simply referred to as printer 1) includes an operation unit 10, a controller 20, and a print unit 30. The operation unit 10 allows an operator to operate the printer 1. The operation unit 10 includes a display 11 for displaying thereon various kinds of information in relation to the printer 1 to inform the operator. In this embodiment, a touch panel type of operation unit 10 is adopted and an operation picture 12 containing various buttons is displayed on a screen of the display 10. Therefore, the operator can operate the printer 1 by touching the operation picture 12.

The controller 20 receives inputs through the operation unit 10 and controls various operations of the printer 1. The controller 20 includes a plurality of data input units 20*a* for acquiring print data from various storage media, such as a card slot and a disk drive. Such a storage medium may be of any kind as far as it can store thereon or therein print data. For example, a CD-ROM, a memory card, or the like, can be used for this purpose.

The operation unit 10 and the controller 20 are fixedly disposed on the upper face of a casing 30*a* accommodating therein the print unit 30. The screen of the display 11 of the operation unit 10 and the face of each data input unit 20*a* of the controller 20, from which a storage medium is inserted, are substantially aligned with the front face of the casing 30*a* of the printer 1, i.e., the left face of the casing 30*a* appearing on this side in FTC. 1. This makes it easy for the operator, who is in front of the printer 1, to operate the display 11 and the data input units 20*a*.

The casing 30*a* is substantially made into a rectangular parallelepiped. Its width D1, i.e., the width of the front face, is smaller than its depth D2. Therefore, the printer 1 can be placed even in a space having a relatively narrow width. An opening 95 is formed in the front face of the casing 30*a* for taking a print box 96, as will be described later, out of the casing 30*a*.

As shown in FIG. 2, the print unit 30 includes a paper supply unit 40, a paper taking-up unit 80, and a conveyance mechanism 38 within the casing 30*a*. The paper supply unit 40 holds a rolled paper. The paper taking-up unit 80 takes up the paper unwound from the paper supply unit 40. The conveyance mechanism 38 is capable of conveying the paper along a conveyance path curved in one direction between the paper supply unit 40 and the paper taking-up unit 80. Between the paper supply unit 40 and the paper taking-up unit 80, a cutting unit 50, an overcoating unit 60, and a printing unit 70 are disposed in this order along the conveyance direction of the paper being conveyed along the conveyance path. A print box 96 is provided near the conveyance path between the paper supply unit 40 and the cutting unit 50.

In this embodiment, "the conveyance direction of the paper" or merely "the conveyance direction" means the direction from the paper supply unit 40 toward the paper taking-up unit 80. In this specification, the conveyance direction may be referred to as "forward direction". In contrast with that, the direction from the paper taking-up unit 80 toward the paper supply unit 40 may be referred to as "backward direction". Further, "the front end of the paper" and "the front end of an image" mean the front ends of the paper and image in the conveyance direction, respectively, while "the rear end of the paper" and "the rear end of an image" mean the rear ends of the paper and image in the conveyance direction, respectively.

The paper supply unit 40 includes a magazine case 41 provided at the most upstream portion of the conveyance path. In the magazine case 41, a roll 45 is put in which a long paper is rolled on a shaft 43 such that the face of the paper to be printed faces outward. The shaft 43 is driven by a motor 43*a*, as shown in FIG. 4, counterclockwise in FIG. 2 when the paper is unwound from the paper supply unit 40 and conveyed downstream in the conveyance direction, and clockwise in FIG. 2 when the paper once unwound is taken up into the paper supply unit 40. The shaft 43 is connected to a not-shown shaft to be driven to rotate by the motor 43*a*, through a one-way clutch 43*c* having the same function as one-way clutches 34*c* and 35*c* as will be described later.

The conveyance mechanism 38 includes a pair of paper feed rollers 31, a pair of turn rollers 32, a pair of pressing rollers 33, a pair of conveyance rollers 34, and a pair of sending-in rollers 35, which are disposed in this order along the conveyance direction. The pair of paper feed rollers 31 can drive the paper, which has been unwound from the roll 45 in the paper supply unit 40, to be conveyed upward. The pair of turn rollers 32 are disposed at positions distant from the cutting unit 50 in the backward direction. The pair of turn rollers 32 turn the conveyance direction of the paper being conveyed upward. The pair of pressing rollers 33 and the pair of conveyance rollers 34 are disposed between the cutting unit 50 and the overcoating unit 60. The pair of pressing rollers 33 can pinch the paper. The pair of conveyance rollers 34 can drive the paper to be conveyed. The pair of sending-in rollers 35 are disposed at positions distant from the printing unit 70 in the conveyance direction. The pair of sending-in rollers 35 send the paper being conveyed in the conveyance direction beyond the printing unit 70, into the paper taking-up unit 80. In this embodiment, each of the paper feed rollers 31, the turn rollers 32, the pressing rollers 33, and the sending-in rollers 35 is made of a resin. Each of the conveyance rollers 34 is made of metal.

The pair of paper feed rollers 31, the pair of turn rollers 32, the pair of pressing rollers 33, the pair of conveyance rollers 34, and the pair of sending-in rollers 35 are arranged along a circumference of a predetermined radius as shown by an alternate long and two short dashes line in FIG. 2. As apparent from FIG. 2, an overcoating head 61 of the overcoating unit 60 and print heads 71 to 73 of the printing unit 70 are also arranged along the circumference, and the paper supply unit 40 and the paper taking-up unit 80 are disposed inside the circumference.

The pair of paper feed rollers 31, the pair of conveyance rollers 34, and the pair of sending-in rollers 35 are connected to motors 31*a*, 34*a*, and 35*a* as shown in FIG. 4, respectively. The motors 31*a*, 34*a*, and 35*a* are controlled by a conveyance control unit 27*a* as shown in FIG. 4, to drive the pair of paper feed rollers 31, the pair of conveyance rollers 34, and the pair of sending-in rollers 35 to rotate, respectively.

Operations of the pair of conveyance rollers 34 and the pair of sending-in rollers 35 will be described with reference to FIGS. 3A and 3B. FTC. 3A shows operations of the pair of conveyance rollers 34 and the pair of sending-in rollers 35 when the paper is conveyed downstream in the conveyance direction. FIG. 3B shows operations of the pair of conveyance rollers 34 and the pair of sending-in rollers 35 when the paper is conveyed backward, i.e., upstream in the conveyance direction. As shown in FIGS. 3A and 3B, the pair of conveyance rollers 34 comprise a drive roller 34*d* and a slave roller 34*e*. The drive roller 34*d* is connected through a one-way clutch 34*c* to a shaft 34*b* to be driven to rotate by a motor 34*a*. Likewise, the pair of sending-in rollers 35 comprise a drive roller 35*d* and a slave roller 35*e*. The drive roller 35*d* is connected through a one-way clutch 35*c* to a shaft 35*b* to be driven to rotate by a motor 35*a*.

The one-way clutches 34*c* and 35*c* are the same in function. Thus, only a function of the one-way clutch 34*c* will be described here. The one-way clutch 34*c* is fixed to the drive roller 34*d* so that they can rotate as one body. In the case that the drive roller 34*d* rotates faster than the rotational speed of the shaft 34*b*, the rotational power of the shaft 34*b* is not transmitted to the drive roller 34*d* and the drive roller 34*d* slips on the shaft 34*b*. In the other cases, the rotational power of the shaft 34*b* is transmitted to the drive roller 34*d* through the one-way clutch 34*c* and the shaft 34*b* and the drive roller 34*d* rotate as one body.

Thus, when the actual conveyance speed of the paper being pinched by the pair of conveyance rollers 34 is lower than the conveyance speed of the paper based on the rotational power of the pair of conveyance rollers 34 driven by the motor 34*a*, the drive force of the motor 34*a* is transmitted to the pair of conveyance rollers 34. In this case, the paper is conveyed by the conveyance force given by the pair of conveyance rollers 34. On the other hand, when the actual conveyance speed of the paper is higher than the conveyance speed of the paper based on the rotational power of the pair of conveyance rollers 34 driven by the motor 34*a*, the drive force of the motor 34*a* is not transmitted to the pair of conveyance rollers 34 and the pair of conveyance rollers 34 can be freely rotated. That is, the pair of conveyance rollers 34 are rotated at a rotational speed corresponding to the actual conveyance speed of the paper.

Supposing that the conveyance speed of the paper based on the rotational power of the pair of conveyance rollers 34 driven by the motor 34*a* is V1 and the conveyance speed of the paper based on the rotational power of the pair of sending-in rollers 35 driven by the motor 35*a* is V2, a case wherein the paper is conveyed downstream in the conveyance direction will be considered with reference to FIG. 3A. In this case, as will be described later, after the leading edge of the paper reaches the pair of sending-in rollers 35 and the paper is pinched by the pair of sending-in rollers 35, the pair of conveyance rollers 34 are stopped to be driven and thus the conveyance speed V1 becomes zero. On the other hand, as for the pair of sending-in rollers 35, the drive force of the motor 35*a* is transmitted to the pair of sending-in rollers 35 through the shaft 35*b* and the one-way clutch 35*c* and thereby the pair of sending-in rollers 35 are driven to rotate. Thus, the paper being pinched by the pair of conveyance rollers 34 is conveyed at the conveyance speed V2. As a result, the pair of conveyance rollers 34 become freely rotatable by the function of the one-way clutch 34*c*.

Next, a case wherein the paper is conveyed backward, i.e., upstream in the conveyance direction, will be considered with reference to FIG. 3B. In this case, as will be described later, because the pair of sending-in rollers 35 are stopped to be driven, the conveyance speed V2 becomes zero. On the other hand, as for the pair of conveyance rollers 34, the drive force of the motor 34*a* is transmitted to the pair of conveyance rollers 34 through the shaft 34*b* and the one-way clutch 34*c* and thereby the pair of conveyance rollers 34 are driven to rotate. Thus, the paper being pinched by the pair of sending-in rollers 35 is conveyed backward at the conveyance speed V1. As a result, the pair of sending-in rollers 35 become freely rotatable by the function of the one-way clutch 35*c*.

The pair of paper feed rollers 31 are also connected to a not-shown shaft to be driven to rotate by the motor 31*a*, through a one-way clutch 31*c* having the same function as the above-described one-way clutches 34*c* and 35*c*. Therefore, by the conveyance control unit 27*a* controlling the respective motors 31*a*, 34*a*, and 35*a*, the pair of paper feed rollers 31, the pair of conveyance rollers 34, and the pair of sending-in rollers 35 can convey the paper unwound from the paper supply unit 40, downstream in the conveyance direction to be taken up in the paper taking-up unit 80, and can again unwind the paper once taken up in the paper taking-up unit 80 and convey the paper unwound from the paper taking-up unit 80 backward, i.e., upstream in the conveyance direction.

The print unit 30 further includes therein an encoder 36 capable of detecting the number of revolutions (the number of pulses) of the pair of conveyance rollers 34. As described above, the pair of conveyance rollers 34 can take a state of being driven by the motor 34*a* to rotate to convey the paper, and a state of being rotated by following the paper being conveyed by the pair of sending-in rollers 35. When the pair of conveyance rollers 34 are in either state, the encoder 36 can detect the number of revolutions of the pair of conveyance rollers 34.

The cutting unit 50 is disposed between the pair of turn rollers 32 and the pair of pressing rollers 33. The cutting unit 50 includes therein a rolling cutter 51 disposed above the conveyance path, a fixed cutting edge 52 disposed below the conveyance path, and a dust box 53.

The rolling cutter 51 is disk-shaped. A cutting edge is formed on the whole circumference of the rolling cutter 51. The center of the rolling cutter 51 is supported by a shaft 51*a*. The rolling cutter 51 is connected through the shaft 51*a* to a driving mechanism 55, as shown in FIG. 4, under the control of a cutting control unit 27*c*. The driving mechanism 55 drives, through the shaft 51*a*, the rolling cutter 51 to rotate and reciprocate perpendicularly to the conveyance path of the paper, i.e., perpendicularly to FIG. 2. The fixed cutting edge 52 is disposed perpendicularly to the conveyance path of the paper. The fixed cutting edge 52 is a rectangular cutting edge longer than the whole width of the conveyance path of the paper.

Thus, in a state wherein the paper is at the cutting position by the cutting unit 50, the cutting control unit 27*c* controls the driving mechanism 55 to rotate the rolling cutter 51 and move it along the width of the paper so that the rolling cutter 51 cooperates with the fixed cutting edge 52 to cut the paper. In the printer 1 of this embodiment, the cutting unit 50 cuts the paper at the front and rear ends of each image, as will be described later.

The dust box 53 is disposed below the rolling cutter 51 and the fixed cutting edge 52. Therefore, when the paper is cut at the front and rear ends of each image and thereby margins between the images are cut off, the margins are collected in the dust box 53.

The overcoating unit 60 is disposed at a position distant from the pair of conveyance rollers 34 in the conveyance direction. The overcoating unit 60 has an overcoating head 61. The overcoating head 61 is for applying a colorless, transparent overcoating (OC) on the surface of the paper on which an image has been printed. By thus applying the overcoating on the surface of the paper, the light resistance of the image printed on the paper is improved and the surface of the paper can be protected. If the material of the overcoating is adequately selected, the glossiness of print is improved and a high-quality print can be provided.

The printing unit 70 is disposed between the overcoating unit 60 and the pair of sending-in rollers 35. The printing unit 70 has three print heads 71 to 73. The print heads 71 to 73 are for printing colors of cyan (C), magenta (M), and yellow (Y), respectively. In the printer 1, the print head 71 corresponding to cyan, the print head 72 corresponding to magenta, and the print head 73 corresponding to yellow are arranged in this order along the conveyance direction. In the printer 1, the pair of conveyance rollers 34 are disposed at the positions distant from the overcoating and printing units 60 and 70 in the backward direction, while the pair of sending-in rollers 35 are disposed at the positions distant from the overcoating and printing units 60 and 70 in the conveyance direction.

In the printer 1 of this embodiment, when the paper unwound from the paper feed unit 40 is conveyed downstream in the conveyance direction, overcoating by the overcoating unit 60 and printing any color image by the printing unit 70 are not performed. When the paper once taken up in the paper taking-up unit 80 disposed at a position distant from the printing unit 70 in the conveyance direction is conveyed backward, i.e., upstream in the conveyance direction, printing an image by the printing unit 70 and overcoating by the overcoating unit 60 are performed. Thus, in the printer 1, a color image can be printed on the surface of the paper in the order of yellow, magenta, and cyan, and an overcoating can be applied to the surface of the paper on which the color image has been printed.

Next, general constructions of the overcoating head 61 and the print heads 71 to 73 will be described. Because the overcoating head 61 and the print heads 71 to 73 have the same construction, only the print head 73 will be described here in detail.

The print head 73 includes a thermal head 73*a* having thereon a large number of not-shown heating elements arranged in a row over the whole width of the conveyance path of the paper; a platen roller 73*b* opposed to the front end of the thermal head 73*a*, i.e., the end of the thermal head 73*a*, near the conveyance path of the paper, on which the heating elements are arranged; a tape-like ribbon 73*c* having thereon an ink region to which ink corresponding to yellow has adhered; a ribbon supply roller 73*d* on which the unused portion of the ribbon 73*c* has been wound; and a ribbon taking-up roller 73*e* on which the used portion of the ribbon 73*c* is taken up.

The thermal head 73*a* can be moved by a lift mechanism 73*f*, as shown in FIG. 4, so as to get near to or far from the conveyance path of the paper. Thus, the thermal head 73*a* can be selectively put at an operative position at which the ribbon 73*c* is pressed onto the paper between the vicinity of the front end of the thermal head 73*a* and the platen roller 73*b*; and at a withdrawal position at which the ribbon 73*c* is not pressed onto the paper.

In the case of the print head 73, when the paper is conveyed between the thermal head 73*a* and the platen roller 73*b* in a state wherein the thermal head 73*a* is put at the operative position, ink adhering to the ribbon 73*c* is heated by the thermal head 73*a* and then transferred onto the paper. Thereby, a color image corresponding to yellow can be printed on the paper. At this time, attendant upon the conveyance of the paper, the ribbon 73*c* is also sent from the ribbon supply roller 73*d* toward the ribbon taking-up roller 73*e*.

Like the print head 73, the overcoating head 61 and the print heads 71 and 72 include thermal heads 61*a*, 71*a*, and 72*a*; platen rollers 61*b*, 71*b*, and 72*b*; ribbons 61*c*, 71*c*, and 72*c*; ribbon supply rollers 61*d*, 71*d*, and 72*d*; ribbon taking-up rollers 61*e*, 71*e*, and 72*e*; and lift mechanisms 61*f*, 71*f*, and 72*f*, respectively.

In the overcoating head 61 and the print heads 71 and 72, in place of the tape-like ribbon 73*c* of the print head 73, having thereon the ink region to which ink corresponding to yellow has adhered, the ribbons 61*c*, 71*c*, and 72*c* are used that have thereon ink regions to which colorless, transparent ink, ink corresponding to cyan, and ink corresponding to magenta, have adhered, respectively.

Pairs of guides 75*a* to 75*c* are disposed in the respective intervals between the overcoating head 61 of the overcoating unit 60 and the print heads 71 to 73 of the printing unit 70. Each of the pairs of guides 75*a* to 75*c* are constituted by two guide boards for guiding the paper, mainly the front end of the paper, being conveyed in the respective intervals between the overcoating head 61 and the print heads 71 to 73. That is, each pair of guides 75*a* to 75*c* are disposed on both sides of the conveyance path of the paper so as to be opposed to each other at a predetermined distance.

The paper taking-up unit 80 includes a housing case 81 at the most downstream position of the conveyance path. The housing case 81 is substantially cylindrical. Part of the housing case 81 is opened to form an insertion opening 82 for the paper. In this embodiment, as shown in FIG. 2, the central angle corresponding to the insertion opening 82 is about 90 degrees. One edge 82*a* of the insertion opening 82 is near the left end of the housing case 81 while the other edge 82*b* is near the upper end of the housing case 81.

The pair of sending-in rollers 35 are disposed near the upper portion of the edge 82*a* of the housing case 81. The paper conveyed downward by the pair of sending-in rollers 35 passes near the edge 82*a* of the insertion opening 82 to be inserted in the housing case 81. The paper inserted in the paper taking-up unit 80 comes into contact with the inner circumferential surface of the housing case 81 to be guided. As a result, in the housing case 81, the paper is taken up in order from its leading edge in accordance with its curling tendency such that the face of the paper to be printed faces outward. Four taking-up rollers 83*a* to 83*d* are provided in the housing case 81 so as to be freely rotatable. Part of each of the taking-up rollers 83*a* to 83*d* protrudes inward beyond the inner circumferential surface of the housing case 81. Thus, the friction force upon the paper coming into contact with the inner circumferential surface of the housing case 81 is relieved and this prevents the paper from being scratched.

The print box 96 is for receiving print papers on which color images have been printed by the printing unit 70 and an overcoating have been applied by the overcoating unit 60 and which have been cut off by the cutting unit 50. The print box 96 is a box whose upper face is opened. The print box 96 is supported at its lower end by a support shaft 97 so as to be swingable. Thereby, the print box 96 can take a state wherein the print box 96 is received within the casing 30*a*, as shown by solid lines in FIG. 2, and a state wherein the vicinity of the upper end of the print box 96 is pulled out from the front face of the casing 30*a*, i.e., the right face of the casing 30*a* in FIG. 2, as shown by broken lines in FIG. 2. Thus, the operator can pull out the upper end portion of the print box 96 from the front face of the casing 30*a* of the printer 1 so that the operator can easily take out papers on which color images have been printed.

A not-shown switchover mechanism is provided in the upper portion of the print box 96. The switchover mechanism is adjacent to a position in the conveyance path more upstream than the pair of turn rollers 32 in the conveyance direction. The switchover mechanism is for switching over the conveyance path of the paper being conveyed backward, i.e., upstream in the conveyance direction, between a case wherein the paper is to be taken up by the paper supply unit 40 and a case wherein a piece of the paper on which a color image has been printed is discharged into the print box 96. Thus, by controlling the switchover mechanism, only pieces of the paper on which color images have been printed can be collected in the print box 96.

An image sensor 90 is adjacent to a position in the conveyance path more upstream than the cutting unit 50 in the conveyance direction. The image sensor 90 can detect an end of an image, mainly the rear end of the image, printed on the paper being conveyed on the conveyance path. A paper sensor 91 is provided at a position from the overcoating unit 60 in the backward direction. The paper sensor 91 can detect an end of the paper. In this embodiment, the upstream end in the conveyance direction of the overcoating unit 60 substantially coincides with the detection position of the paper sensor 91.

As shown in FIG. 4, to the controller 20 connected are the motor 43*a* for driving the shaft 43 of the paper supply unit 40; the motors 31*a*, 34*a*, and 35*a* for driving the pair of paper feed rollers 31, the pair of conveyance rollers 34, and the pair of sending-in rollers 35, respectively; the encoder 36 for detecting the number of revolutions of the pair of conveyance rollers 34; the driving mechanism 55 for the rolling cutter 51 of the cutting unit 50; the lift mechanisms 61*f* and 71*f* to 73*f* and drivers 61*g* and 71*g* to 73*g* for the thermal heads 61*a* and 71*a* to 73*a* of the overcoating and printing units 60 and 70; the image sensor 90; the paper sensor 91; and the operation unit 10.

The controller 20 is made up of hardware components, such as a CPU, a ROM, and a RAM, controlled by an adequate software program. The controller 20 includes therein a maximum taking-up quantity storage unit 21, a print information storage unit 22, a necessary taking-up quantity calculation unit 23, a comparing unit 24, a taking-up quantity determining unit 25, a conveyance quantity detecting unit 26, a conveyance control unit 27*a*, a printing control unit 27*b*, and a cutting control unit 27*c*.

The maximum taking-up quantity storage unit 21 stores therein, as the maximum taking-up quantity, the maximum length of the paper being conveyed forward, that can be conveyed downstream in the conveyance direction of the printing unit 70, when the paper is conveyed from the paper supply unit 40 to the paper taking-up unit 80. The maximum taking-up quantity can be calculated by summing up the length of the conveyance path between the printing position of the print head 73 disposed at the most downstream position in the conveyance direction in the printing unit 70 and the insertion opening 82 of the paper taking-up unit 80, and the length of the paper that can be taken up in the housing case 81 of the paper taking-up unit 80. The maximum taking-up quantity is input to the maximum taking-up quantity storage unit 21 by the operator.

The maximum taking-up quantity varies mainly in accordance with the size of the housing case 81. The length of the paper that can be taken up in the housing case 81 may be equal to the maximum length of the paper that can be actually received in the housing case 81, or shorter than the maximum length of the paper that can be received in the housing case 81. In any case, the operator can set the maximum taking-up quantity to an arbitrary value. Thus, in this embodiment, as the length of the paper that can be taken up in the housing case 81, for use in calculation of the maximum taking-up quantity, a length has been set that is in a range that the paper is not damaged and scratched in the housing case 81, and shorter than the maximum length of the paper that can be received in the housing case 81.

The print information storage unit 22 stores therein various set values upon printing color images. The set values include a print length, in the conveyance direction, of one frame for each print kind; the number of prints, i.e., the number of frames; a length of a margin to be formed between neighboring images; and an additional length for heat radiation of the head. As the print length of one frame for each print kind, a plurality of values are stored to correspond to a plurality of print kinds, such as a standard size and a panorama size. As the number of prints, a value input by the operator for each order before printing is stored. As each of the length of the margin between images and the additional length for heat radiation of the head, a value input by the operator before printing is stored. The additional length is set to a length such that the paper is opposed to each of the thermal heads 61*a* and 71*a* to 73*a* until the temperatures of the thermal heads 71*a* to 73*a* heated for printing images and the thermal head 61*a* heated for overcoating become substantially equal to the temperature of the surroundings after electrification is stopped. In this embodiment, the additional length is calculated by the product of the time necessary for the temperature of any of the heated thermal heads 61*a* and 71*a* to 73*a* to become substantially equal to the temperature of the surroundings, and the conveyance speed of the paper being conveyed backward, i.e., upstream in the conveyance direction.

In this embodiment, "one order" means one set of frames of color images to be dealt with by the printer 1. For example, in the case that the printer 1 deals with, as one set, a plurality of frames of color images corresponding to an order from one client, the plurality of frames of color images corresponding to the order from the client are considered to be the plurality of frames of color images contained in one order. On the other hand, in the case that the printer 1 deals with, as one set, a plurality of frames of color images corresponding to orders from a plurality of clients, the plurality of frames of color images corresponding to the orders from the plurality of clients are considered to be the plurality of frames of color images contained in one order. Further, other than the above case wherein the order or orders from one or more clients are considered to be one order, in the case that an operator gives the printer 1 a print instruction for recording a plurality of frames of color images irrespective of which client each frame is in connection with, the plurality of frames of color images in accordance with the print instruction are considered to be the plurality of frames of color images contained in one order.

The necessary taking-up quantity calculation unit 23 calculates, as a necessary taking-up quantity, the minimum length of the paper necessary for printing all of a plurality of frames of color images contained in one order. That is, for printing all of a plurality of frames of color images contained in one order, a length of the paper on which the color images can be printed must have been conveyed downstream in the conveyance direction of the printing unit 70 before the printing unit 70 starts printing the color images. Thus, a length of the paper being conveyed from the paper supply unit 40 toward the paper taking-up unit 80, to be conveyed beyond the printing position of the print head 73 of the printing unit 70 for printing all of a plurality of frames of color images contained in one order, is calculated as the necessary taking-up quantity.

Figure 5:
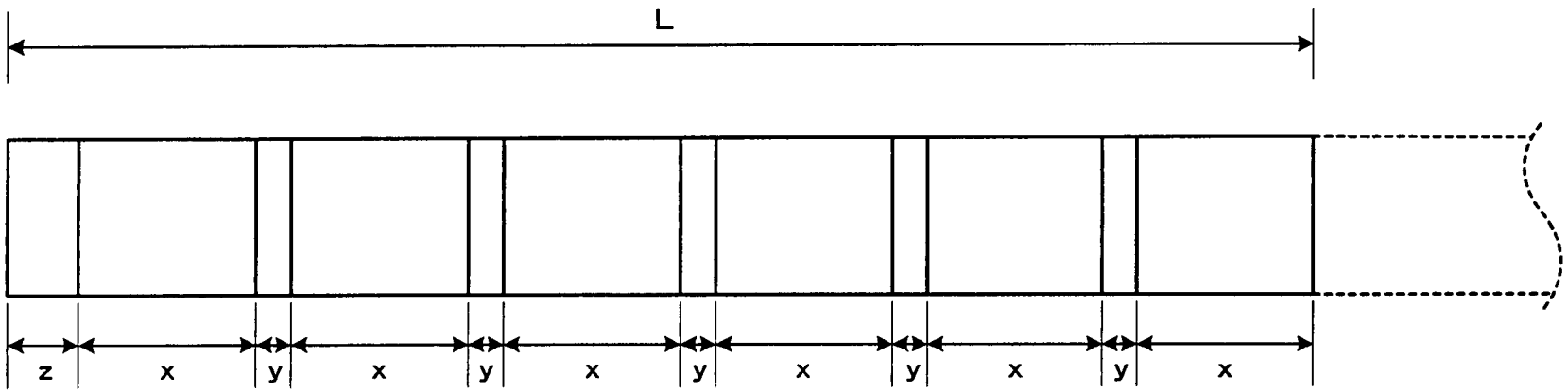
FIG. 5 is a view showing a state wherein a plurality of frames of color images contained in one order are printed near the leading edge of a paper.

Here, the necessary taking-up quantity will be described with reference to FIG. 5. FIG. 5 is a view showing a state wherein a plurality of frames of color images contained in one order are printed near the leading edge of the paper. FIG. 5 shows a case wherein six images of the same print kind are contained in one order. As shown in FIG. 5, a region corresponding to the additional length z for heat radiation of head is provided near the leading edge of the paper, i.e., the left end in FIG. 5. From the region toward the backward direction, i.e., rightward in FIG. 5, a region corresponding to the print length x and a region corresponding to the margin length y are alternately provided the times corresponding to the number n of prints.

Thus, when the operator inputs the print kind and the number of prints of color images contained in one order before starting to print, the necessary taking-up quantity calculation unit 23 calculates, on the basis of the values stored in the print information storage unit 22, the necessary taking-up quantity L corresponding to one order by the following equation:

$$L=z+x\times n+y\times(n-1).$$

The comparing unit 24 compares the necessary taking-up quantity calculated by the necessary taking-up quantity calculation unit 23 with the maximum taking-up quantity stored in the maximum taking-up quantity storage unit 21. The comparing unit 24 obtains a comparison result as to whether the necessary taking-up quantity is larger or smaller than the maximum taking-up quantity.

The taking-up quantity determining unit 25 determines a length of the paper to be actually conveyed downstream in the conveyance direction of the printing unit 70, i.e., the actual taking-up quantity, before the conveyance direction of the paper is switched over from the forward direction to the backward direction, that is, a length of the paper to be conveyed forward after the leading edge of the paper being conveyed forward passes the print head 73 of the printing unit 70. The taking-up quantity determining unit 25 determines the taking-up quantity on the basis of the comparison result in the comparing unit 24. That is, when the comparing unit 24 obtains a comparison result indicating that the necessary taking-up quantity is not more than the maximum taking-up quantity, the taking-up quantity determining unit 25 adopts the necessary taking-up quantity as the actual taking-up quantity. Contrastingly, when the comparing unit 24 obtains a comparison result indicating that the necessary taking-up quantity is more than the maximum taking-up quantity, the taking-up quantity determining unit 25 adopts the maximum taking-up quantity as the actual taking-up quantity.

The conveyance quantity detecting unit 26 detects a conveyance quantity of the paper on the basis of the number of revolutions of the pair of conveyance rollers 34 detected by the encoder 36 after the leading edge of the paper is detected by the paper sensor 91. That is, the conveyance quantity detecting unit 26 detects the length of the paper having been conveyed downstream in the conveyance direction of the detection position of the paper sensor 91. As a result, the conveyance quantity detecting unit 26 can detect the length of the paper between the leading edge of the paper and the print head 73 of the printing unit 70 before the conveyance direction of the paper is switched over from the forward direction to the backward direction. As will be described later, when the paper is conveyed downstream in the conveyance direction, after the leading edge of the paper reaches the pair of sending-in rollers 35, the paper is conveyed by not the conveyance force given by the pair of conveyance rollers 34 but the conveyance force given by the pair of sending-in rollers 35. Even in this case, the conveyance quantity detecting unit 26 detects the conveyance quantity of the paper always on the basis of the number of revolutions of the pair of conveyance rollers 34.

The conveyance quantity detecting unit 26 can detect the conveyance quantity of the paper not only when the paper is conveyed downstream in the conveyance direction but also when the paper is conveyed upstream in the conveyance direction. Therefore, after the conveyance direction of the paper is switched over from the forward direction to the backward direction, the position of the leading edge of the paper can be detected by subtracting the conveyance quantity upstream in the conveyance direction after the switchover of the conveyance direction, from the conveyance quantity downstream in the conveyance direction before the switchover of the conveyance direction.

The conveyance control unit 27*a* controls the motors 43*a*, 31*a*, 34*a*, and 35*a* for driving the shaft 43, the pair of paper feed rollers 31, the pair of conveyance rollers 34, and the pair of sending-in rollers 35 to convey the paper from the paper supply unit 40 toward the paper taking-up unit 80 and convey the paper backward from the paper taking-up unit 80 toward the paper supply unit 40. The printing control unit 27*b* controls the timings of lifting up and down the thermal head 61*a* of the overcoating unit 60 and the thermal heads 71*a* to 73*a* of the printing unit 70, and the timings of printing by the thermal heads 61*a* and 71*a* to 73*a*. The cutting control unit 27*c* controls the timings of cutting by the cutting unit 50.

The function of the conveyance control unit 27*a* will be described in more detail. First, when the paper is conveyed downstream in the conveyance direction, the drive of the motor 34*a* is stopped until the leading edge of the paper passes the pair of conveyance rollers 34 and reaches the detection position of the paper sensor 91. In addition, the motors 43*a* and 31*a* are controlled such that the conveyance speed of the paper based on the rotational power of the pair of paper feed rollers 31 is higher than the speed of sending out the paper based on the rotational power of the shaft 43. At this time, the shaft 43 and the pair of conveyance rollers 34 are freely rotatable by the functions of the one-way clutches 43*c* and 34*c*. The pair of paper feed rollers 31 are driven by the motor 31*a* through the one-way clutch 31*c*. Thus, the paper is conveyed by the conveyance force given by the pair of paper feed rollers 31.

Afterward, the drives of the motors 43*a* and 31*a* are stopped and only the motor 34*a* is driven until the leading edge of the paper is pinched by the pair of sending-in rollers 35. At this time, the shaft 43 and the pair of paper feed rollers 31 are freely rotatable by the functions of the one-way clutches 43*c* and 31*c*. The pair of conveyance rollers 34 are driven by the motor 34*a* through the one-way clutch 34*c*. Thus, the paper is conveyed only by the conveyance force given by the pair of conveyance rollers 34.

When the leading edge of the paper is pinched by the pair of sending-in rollers 35, the drives of the motors 43*a*, 31*a*, and 34*a* are stopped and only the motor 35*a* is driven. At this time, the shaft 43, the pair of paper feed rollers 31, and the pair of conveyance rollers 34 are freely rotatable by the functions of the one-way clutches 43*c*, 31*c*, and 34*c*. The pair of sending-in rollers 35 are driven by the motor 35*a* through the one-way clutch 35*c*. Thus, the paper is conveyed only by the conveyance force given by the pair of sending-in rollers 35.

On the other hand, when the paper is conveyed backward, i.e., upstream in the conveyance direction, the drive of the motor 35*a* is stopped until the paper is cut at the rear end of the color image printed at the most upstream position in the conveyance direction. In addition, the motors 43*a*, 31*a*, and 34*a* are controlled such that the speed of rewinding the paper based on the rotational power of the shaft 43, the conveyance speed of the paper based on the rotational power of the pair of paper feed rollers 31, and the conveyance speed of the paper based on the pair of conveyance rollers 34 are equal to each other. At this time, the shaft 43, the pair of paper feed rollers 31, and the pair of conveyance rollers 34 are driven by the motors 43*a*, 31*a*, and 34*a* through the one-way clutches 43*c*, 31*c*, and 34*c*, respectively. The pair of sending-in rollers 35 are freely rotatable by the function of the one-way clutch 35*c*. Thus, the paper is conveyed by the conveyance forces given by the shaft 43, the pair of paper feed rollers 31, and the pair of conveyance rollers 34.

After the paper is cut at the rear end of the color image printed at the most upstream position in the conveyance direction, the motors 43*a* and 31*a* are controlled such that the speed of rewinding the paper based on the rotational power of the shaft 43, and the conveyance speed of the paper based on the rotational power of the pair of paper feed rollers 31 are equal to each other. The shaft 43 and the pair of paper feed rollers 31 are driven by the motors 43*a* and 31*a* through the one-way clutches 43*c* and 31*c*, respectively. Thereby, the portion of the paper upstream in the conveyance direction of the cut position is rewound in the paper supply unit 40. The motor 34*a* is driven and the drive of the motor 35*a* is stopped. The pair of conveyance rollers 34 are driven by the motor 34*a* through the one-way clutch 34*c* and the pair of sending-in rollers 35 are freely rotatable by the function of the one-way clutch 35*c*. Thus, the portion of the paper downstream in the conveyance direction of the cut position is conveyed backward only by the conveyance force given by the pair of conveyance rollers 34.

The printing control unit 27*b* controls the timings of lifting up and down the thermal head 61*a* of the overcoating unit 60 and the thermal heads 71*a* to 73*a* of the printing unit 70, and the timings of printing by the thermal heads 61*a* and 71*a* to 73*a*. More specifically, the printing control unit 27*b* controls the timings of lifting up and down the thermal heads 61*a* and 71*a* to 73*a* such that the thermal heads 61*a* and 71*a* to 73*a* are at their withdrawal positions while the paper is conveyed downstream in the conveyance direction, and put at their operative positions before the paper is conveyed backward, i.e., upstream in the conveyance direction. In addition, the printing control unit 27*b* controls the timings of printing by the thermal heads 71*a* to 73*a* such that a plurality of frames of color images contained in one order are printed at intervals each corresponding to the length of a margin and no image is printed in a region corresponding to the additional length nearer to the leading edge of the paper than the last printed color image. Further, the printing control unit 27*b* controls the overcoating unit 60 such that an overcoating is applied only on each region of the paper on which a color image has been printed. The cutting control unit 27*c* controls the timings of cutting by the cutting unit 50.

Figure 6:
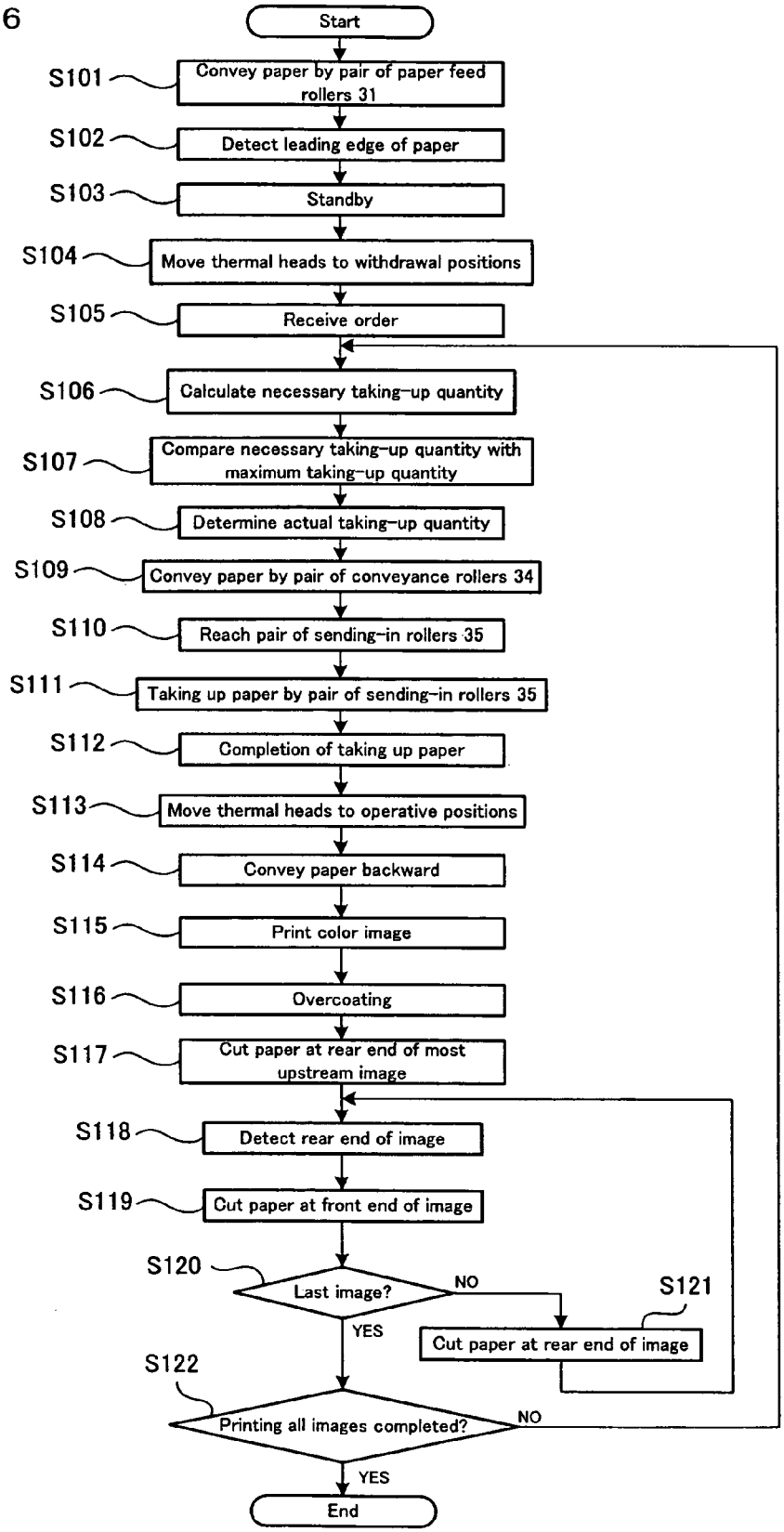
FIG. 6 is a flowchart of a procedure of an operation of the printer of FIG. 1.

Next, an operation of the printer 1 for printing images will be described with reference to FIG. 6. FIG. 6 is a flowchart of a procedure of the operation of the printer 1.

First, the leading portion of the paper unwound from the paper roll 45 put in the paper supply unit 40, by driving the shaft 43 to rotate, is conveyed only by the conveyance force by the pair of paper feed rollers 31, in Step S101. The conveyance by the pair of paper feed rollers 31 continues until the leading edge of the paper passes through the pair of conveyance rollers 34 and reaches the detection position of the paper sensor 91, in Step S102. When the paper sensor 91 detects the leading edge of the paper, the paper sensor 91 sends, to the controller 20, a detection signal indicating that the leading edge of the paper has been detected.

At the time when the leading edge of the paper reaches the detection position of the paper sensor 91, the conveyance of the paper is stopped and the printer 1 falls in a standby state, in Step S103. At this time, if the thermal heads 61*a* and 71*a* to 73*a* are at their operative positions, they are moved to their withdrawal positions, in Step S104.

Afterward, an order is received from an operator and a print kind and the number of prints of color images contained in one order are input, in Step S105. As a preparation for starting the conveyance of the paper, the necessary taking-up quantity calculation unit 23 then calculates a necessary taking-up quantity corresponding to the one order on the basis of information stored in the print information storage unit 22, in Step S106. The comparing unit 24 then compares the necessary taking-up quantity with the maximum taking-up quantity stored in the maximum taking-up quantity storage unit 21, in Step S107. On the basis of the comparison result, the taking-up quantity determining unit 25 determines an actual taking-up quantity, in Step S108. After the preparation for the conveyance of the paper is thus completed, the paper is conveyed only by the conveyance force given by the pair of conveyance rollers 34, in Step S109. At this time, either of the shaft 43 of the paper supply unit 40 and the pair of paper feed rollers 31 is freely rotatable.

Afterward, while the thermal heads 61*a* and 71*a* to 73*a* are at their withdrawal positions, the paper is continued to be conveyed only by the conveyance force given by the pair of conveyance rollers 34 until the leading portion of the paper passes through the overcoating unit 60 and the printing unit 70 without overcoating and printing operations and reaches the pair of sending-in rollers 35, in Step S110. After the leading portion of the paper reaches the pair of sending-in rollers 35 and is pinched by the pair of sending-in rollers 35, the paper is conveyed only by the conveyance force given by the pair of sending-in rollers 35, to be sent in the housing case 81 of the paper taking-up unit 80 in order from the leading portion of the paper, in Step S111. As the paper is sent in the housing case 81, the leading edge of the paper is guided by the inner circumferential surface of the housing case 81 and the taking-up rollers 83*a* to 83*d* and the paper is taken up in accordance with its curling tendency. At the time when the leading edge of the paper reaches the pair of sending-in rollers 35, the pair of conveyance rollers 34 are switched by the function of the one-way clutch 34*c* from a state of giving the paper the conveyance force to a state of rotating by following the paper being conveyed by the pair of sending-in rollers 35.

Afterward, at the time when a length of the paper corresponding to the taking-up quantity determined by the taking-up quantity determining unit 25 is conveyed downstream in the conveyance direction of the printing position by the print head 73, taking up the paper is completed and the forward conveyance of the paper is stopped, in Step S112. That is, the conveyance quantity of the paper detected on the basis of the number of revolutions of the pair of conveyance rollers 34 detected by the encoder 36 after the paper sensor 91 detects the leading edge of the paper becomes equal to the length obtained by summing the taking-up quantity determined by the taking-up quantity determining unit 25 and the length of the conveyance path in the overcoating unit 60 and the printing unit 70. When the conveyance quantity detecting unit 26 detects that, the conveyance control unit 27*a* stops taking up the paper to stop the forward conveyance of the paper. At this time, the print head 73 is opposed to the rear end of an image to be printed on the most upstream portion in the conveyance direction of the paper of the length corresponding to the taking-up quantity.

The thermal head 61*a* of the overcoating unit 60 and the thermal heads 71*a* to 73*a* of the printing unit 70 are then moved from their withdrawal positions to their operative positions at once, in Step S113. Afterward, the paper is started to be conveyed backward, i.e., upstream in the conveyance direction, by the conveyance force given by the pair of paper feed rollers 31 and the pair of conveyance rollers 34, in Step S114. At this time, the pair of paper feed rollers 31 and the pair of conveyance rollers 34, which were freely rotatable, are driven to rotate so as to convey the paper upstream in the conveyance direction. On the other hand, the pair of sending-in rollers 35 become freely rotatable by the function of the one-way clutch 35*c*. In addition, the shaft 43 of the paper supply unit 40 is driven to rotate so as to rewind up the paper in the magazine case 41.

While the paper is conveyed backward, i.e., upstream in the conveyance direction, each color image contained in one order is printed in the manner that printing corresponding to yellow by the print head 73, printing corresponding to magenta by the print head 72, and printing corresponding to cyan by the print head 71 are performed in this order. Each color image is thus completed by printing in the order of yellow, magenta, and cyan, in Step S115. Subsequently, the overcoating head 61 applies an overcoating on the surface of the paper on which the color image has been printed, in Step S116.

In this embodiment, when the necessary taking-up quantity is less than the maximum taking-up quantity, printing color images is started simultaneously with start of conveying the paper backward, i.e., upstream in the conveyance direction, and all of a plurality of frames of color images contained in one order are intermittently printed so that a predetermined margin is formed in each interval between the images. Contrastingly, when the necessary taking-up quantity is more than the maximum taking-up quantity, printing color images is started simultaneously with start of conveying the paper backward, i.e., upstream in the conveyance direction, and part of a plurality of frames of color images contained in one order are intermittently printed so that a predetermined margin is formed in each interval between the images. That is, as described before, the color images are printed on the paper so that an image region and a margin are alternately disposed. But, no image is printed in a region corresponding to the additional length for heat radiation of the head, near the leading edge of the paper. In the printing unit 70, if image regions are opposed to at least two of the three print heads 71 to 73 at the same timing, the two print heads operate at once to print. On the other hand, overcoating by the overcoating unit 60 may be performed in parallel with printing color images by the printing unit 70. Thus, in the printing unit 70 and the overcoating unit 60, printing and overcoating are performed for a plurality of frames of color images that can be printed on the paper of the length corresponding to the taking-up quantity determined by the taking-up quantity determining unit 25 or the paper of the length corresponding to the maximum taking-up quantity.

When the rear end of the color image printed on the most upstream portion in the conveyance direction of the paper, which coincides with the rear end of the paper of the length corresponding to the taking-up quantity determined by the taking-up quantity determining unit 25, reaches the cutting position by the cutting unit 50, the backward conveyance of the paper is stopped and the paper is cut at the rear end of the color image, in Step S117. The timing when the rear end of the color image reaches the cutting position by the cutting unit 50 is detected on the basis of the conveyance quantity detected by the conveyance quantity detecting unit 26. After the paper is thus cut, the paper portion, on which no image has been formed, upstream in the conveyance direction of the color image printed on the most upstream portion, that is, the paper portion upstream of the rear end of the paper of the length corresponding to the taking-up quantity determined by the taking-up quantity determining unit 25, is rewound up in the paper supply unit 40.

Subsequently, the paper is again conveyed backward only by the conveyance force given by the pair of conveyance rollers 34. When the rear end of the most upstream image in the conveyance direction reaches the detection position of the image sensor 90, the image sensor 90 sends, to the controller 20, a detection signal indicating that the rear end of the image has been detected, in Step S118. The conveyance quantity detecting unit 26 then detects, on the basis of the number of revolutions of the pair of conveyance rollers 34 detected by the encoder 36 after the image sensor 90 detects the rear end of the image, that the front end of the color image has reached the cutting position by the cutting unit 50. At this time, the backward conveyance of the paper is stopped and the paper is cut at the front end of the color image, in Step S119.

Every time when the paper is cut at the front end of a color image, it is judged whether or not the color image printed on the cut-off paper is the last image printed on the nearest portion to the leading edge of the paper, in Step S120. If the image is judged not to be the last image, the paper is again conveyed backward. The conveyance quantity detecting unit 26 then detects, on the basis of the number of revolutions of the pair of conveyance rollers 34 detected by the encoder 36 after the paper is cut at the front end of the color image, that the rear end of the color image neighboring the downstream side in the conveyance direction of the color image at the front end of which the paper was cut in Step S119, has reached the cutting position by the cutting unit 50. At this time, the backward conveyance of the paper is stopped and the paper is cut at the rear end of the color image, in Step S121. The flow then returns to Step S118 and the same procedure as described above is repeated.

When the color image printed on the cut-off paper is judged to be the last image, it is judged in Step S122 whether or not printing all the color images contained in one order has been completed. If printing all the color images contained in one order is judged not to have been completed, the flow then returns to Step S106 and the same procedure as described above is repeated. When printing all the color images contained in one order is judged to have been completed, the flow then ends.

The case wherein printing all the color images contained in one order is judged in Step S122 not to have been completed, is, for example, a case wherein the comparing unit 24 has judged the necessary taking-up quantity to be longer than the maximum taking-up quantity and the taking-up quantity determining unit 25 has adopted the maximum taking-up quantity as the final taking-up quantity. In this case, the remaining color images of the color images contained in one order, that could not be printed on the paper of the length of the maximum taking-up quantity, are printed subsequently. Until printing all the color images contained in one order is thus completed, the same procedure as described above is repeated.

As described above, in the printer 1 of this embodiment, after the paper is conveyed forward, a plurality of frames of color images can be printed on the paper being conveyed backward by the conveyance force by the pair of conveyance rollers 34 disposed upstream in the conveyance direction of the overcoating unit 60 and the printing unit 70. Therefore, the color images can be printed on the whole region from the position opposed to the print head 73 at the time when the backward conveyance of the paper is started, to the leading edge of the paper. In addition, because no variation of load occurs in the conveyance of the paper, good images can be printed. Further, a plurality of frames of color images can be recorded on the paper by one recording operation corresponding to one set of forward and backward movements of the paper. Thus, the time loss attendant upon switchover of the conveyance direction in the conveyance mechanism 38 can be reduced and a plurality of frames of color images can be recorded with a high processing performance.

In addition, the printing control unit 27*b* makes control such that a plurality of frames of color images are printed at intervals each corresponding to the length of a margin and no image is printed in a region corresponding to the additional length nearer to the leading edge of the paper than the last printed color image. Therefore, each of the thermal heads 71*a* to 73*a* is opposed to the paper being conveyed backward, i.e., upstream in the conveyance direction, for a period of time after the last color image is printed. Thus, heat on each of the thermal heads 71*a* to 73*a* rapidly diffuse through the paper, and the temperature of the thermal heads 71*a* to 73*a*, which was high immediately after the images were printed, goes down rapidly. As a result, with suppressing breakdown of the printing unit 70, a plurality of frames of color images can be printed into desired sizes at intervals each corresponding to the length of a margin. Further, because the printing control unit 27*b* makes control such that an overcoating is applied only in each region of the paper on which a color image has been printed, the thermal head 61*a* is facing the paper being conveyed backward, i.e., upstream in the conveyance direction, for a period of time after overcoating is ended. Therefore, the temperature of the thermal head 61*a*, which was at a high temperature immediately after overcoating was ended, can be rapidly lowered. Thus, breakdown of the overcoating unit 60 can be suppressed. From the viewpoint that the temperatures of the thermal heads 61*a* and 71*a* to 73*a* are lowered as rapidly as possible after electrification is ended, the paper is preferably higher in heat conductivity than the ink ribbons.

The additional length is set to a length calculated by the product of the time necessary for the temperature of any of the thermal heads 61*a* and 71*a* to 73*a* to become substantially equal to the temperature of the surroundings immediately after the end of electrification, and the conveyance speed of the paper being conveyed backward, i.e., upstream in the conveyance direction. Thus, any of the thermal heads 71*a* to 73*a* is opposed to the paper until the temperature of the thermal heads 71*a* to 73*a* becomes substantially equal to the temperature of the surroundings after the last color image is printed. The thermal head 61*a* is opposed to the paper until the temperature of the thermal head 61*a* becomes substantially equal to the temperature of the surroundings after the overcoating on the last color image is completed. Therefore, the printing unit 70 and the overcoating unit 60 are hard to break down in comparison with a case wherein the thermal heads 61*a* and 71*a* to 73*a* fall in a state of being not opposed to the paper when the temperatures of the thermal heads 61*a* and 71*a* to 73*a* are higher than the temperature of the surroundings.

In the above-described embodiment, the additional length is calculated by the product of the time necessary for the temperature of any of the thermal heads 61*a* and 71*a* to 73*a* to become substantially equal to the temperature of the surroundings after the end of electrification, and the conveyance speed of the paper being conveyed backward, i.e., upstream in the conveyance direction. However, the calculation method of the additional length is not limited to this. Further, even in the case that the additional length is set to be shorter than the length obtained by the above calculation, it suffices if the temperature of each of the thermal heads 61*a* and 71*a* to 73*a* can be lowered from the temperature immediately after the end of electrification to a temperature that brings about some degree of the effect of suppression of breakdown.

In the above-described embodiment, the necessary taking-up quantity is calculated on the basis of the number of frames of color images contained in one order, the print length of one frame of each color image, the length of each margin to be formed between color images, and the additional length. However, the present invention is not limited to this. For example, the necessary taking-up quantity may be calculated on the basis of the number of frames of color images contained in one order, the print length of one frame of each color image, and the length of each margin to be formed between color images. In this case, when the paper is conveyed, the length of the paper to be conveyed downstream in the conveyance direction of the printing unit 70 is set to be longer than the necessary taking-up quantity by the additional length.

In the above-described embodiment, the paper is conveyed downstream in the conveyance direction until the leading edge of the paper reaches a position distant in the conveyance direction from the print head 73 of the printing unit 70 by the length corresponding to the taking-up quantity determined by the taking-up quantity determining unit 25. However, the present invention is not limited to this. The conveyance quantity of the paper downstream in the conveyance direction can be changed to an arbitrary value as far as the leading edge of the paper reaches a position beyond the print head 73. In this case, by properly controlling the number of images to be printed, the size of each image, the length of each margin, etc., a non-print region is formed on the paper between the leading edge side and the last printed color image.

In the above-described embodiment, the conveyance quantity detecting unit 26 detects a conveyance quantity of the paper on the basis of the number of revolutions of the pair of conveyance rollers 34 detected by the encoder 36 after the paper sensor 91 detects the leading edge of the paper. In a modification, however, the conveyance quantity detecting unit 26 may detect a conveyance quantity of the paper by another method.

In the above-described embodiment, the dye sublimation printer 1 prints a color image by three print heads 71 to 73 that are brought into contact with a paper as a recording medium. However, the construction of the image recording unit of the printer is not limited to this as far as it has a print head or heads to be brought into contact with the recording medium and can record a color image. Therefore, the present invention can be applied to printers each having a print head or heads to be brought into contact with a recording medium, including thermal transfer printers and thermal printers. In addition, the image recording unit need not always have a plurality of image recording heads. The image recording unit may have only one image recording head capable of recording a color image.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A one-path type color thermal printer comprising:

a supply unit for storing therein a recording medium;

an image recording unit including a plurality of heating elements and capable of recording a color image by selectively heating the heating elements;

a conveyance mechanism capable of conveying the recording medium in a first direction from the supply unit toward the image recording unit and in a second direction reverse to the first direction, with opposing the recording medium to the image recording unit;

a conveyance controller that controls the conveyance mechanism to convey the recording medium in the first direction until a leading edge of the recording medium reaches a position distant in the first direction from the image recording unit, and to then convey the recording medium in the second direction; and an image recording controller that controls the image recording unit to record a plurality of frames of color images on the recording medium being conveyed in the second direction by the conveyance mechanism, and form a non-record region in which no image is recorded, on the recording medium between the leading edge and the last recorded color image.

2. The printer according to claim 1, wherein the printer further comprises a length calculator that calculates a minimum length of the recording medium necessary for recording the plurality of frames of color images by the image recording unit, on the basis of the number of frames of color images to be recorded by the image recording unit, a desired size of each color image, and desired margins between the color images;

the conveyance controller controls the conveyance mechanism to convey the recording medium in the first direction until the leading edge of the recording medium reaches the position distant in the first direction from the image recording unit by more than the length calculated by the length calculator, and then convey the recording medium in the second direction; and the image recording controller controls the image recording unit to record the plurality of frames of color images on the recording medium being conveyed in the second direction by the conveyance mechanism, into the respective desired sizes at intervals corresponding to the desired margins, and form the non-record region in which no image is recorded, on the recording medium between the leading edge and the last recorded color image.

3. A printer comprising:

a supply unit storing therein a long recording medium;

an image recording unit including a large number of heating elements and capable of recording a color image by the heating elements selectively heated;

a conveyance mechanism capable of conveying the recording medium in a first direction from the supply unit toward the image recording unit and in a second direction reverse to the first direction, with opposing the recording medium to the image recording unit;

a conveyance controller that controls the conveyance mechanism to convey the recording medium in the first direction until a leading edge of the recording medium reaches a position distant in the first direction from the image recording unit, and to then convey the recording medium in the second direction; and an image recording controller that controls the image recording unit to record a plurality of frames of color images on the recording medium being conveyed in the second direction by the conveyance mechanism, and form a non-record region in which no image is recorded, on the recording medium between the leading edge and the last recorded color image, wherein the printer further comprises a length calculator that calculates a length exceeding a minimum length of the recording medium necessary for recording the plurality of frames of color images by the image recording unit, determined on the basis of the number of frames of color images to be recorded by the image recording unit, a desired size of each color image, and desired margins between the color images;

the conveyance controller controls the conveyance mechanism to convey the recording medium in the first direction until the leading edge of the recording medium reaches the position distant in the first direction from the image recording unit by not less than the length calculated by the length calculator, and then convey the recording medium in the second direction; and the image recording controller controls the image recording unit to record the plurality of frames of color images on the recording medium being conveyed in the second direction by the conveyance mechanism, into the respective desired sizes at intervals corresponding to the desired margins, and form the non-record region in which no image is recorded, on the recording medium between the leading edge and the last recorded color image.

4. A printer comprising:

a supply unit storing therein a long recording medium;

an image recording unit including a large number of heating elements and capable of recording a color image by the heating elements selectively heated;

a conveyance mechanism capable of conveying the recording medium in a first direction from the supply unit toward the image recording unit and in a second direction reverse to the first direction, with opposing the recording medium to the image recording unit;

a conveyance controller that controls the conveyance mechanism to convey the recording medium in the first direction until a leading edge of the recording medium reaches a position distant in the first direction from the image recording unit, and to then convey the recording medium in the second direction; and an image recording controller that controls the image recording unit to record a plurality of frames of color images on the recording medium being conveyed in the second direction by the conveyance mechanism, and form a non-record region in which no image is recorded, on the recording medium between the leading edge and the last recorded color image, wherein a length of the non-record region is not less than a length obtained by multiplying a time period necessary for temperatures of the heating elements immediately after it ends to record the plurality of frames of color images on the recording medium, to become substantially equal to a temperature of surroundings, by a conveyance speed of the recording medium in the second direction.

* * * * *